US010724307B2

(12) United States Patent
Bushman

(10) Patent No.: US 10,724,307 B2
(45) Date of Patent: Jul. 28, 2020

(54) ANNULAR PACKER SYSTEM AND METHOD

(71) Applicant: Cameron International Corporation, Houston, TX (US)

(72) Inventor: Jerod Christopher Bushman, Tomball, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 313 days.

(21) Appl. No.: 15/351,034

(22) Filed: Nov. 14, 2016

(65) Prior Publication Data

US 2018/0135379 A1 May 17, 2018

(51) Int. Cl.

| | |
|---|---|
| ***E21B 23/00*** | (2006.01) |
| ***E21B 17/07*** | (2006.01) |
| ***E21B 17/01*** | (2006.01) |
| ***E21B 33/08*** | (2006.01) |

(52) U.S. Cl.

CPC ..... *E21B 17/07* (2013.01); *E21B 17/01* (2013.01); *E21B 33/085* (2013.01)

(58) Field of Classification Search

CPC ..... E21B 17/07; E21B 17/01; E21B 33/085; F16J 15/3204; F16J 15/3232

See application file for complete search history.

(56) References Cited

U.S. PATENT DOCUMENTS

| | | | | |
|---|---|---|---|---|
| 3,081,102 | A | 3/1963 | Murray et al. | |
| 3,778,881 | A * | 12/1973 | Knapp | B23P 6/00 277/520 |
| 4,030,354 | A | 6/1977 | Scott | |
| 4,440,404 | A * | 4/1984 | Roach | F04B 53/164 277/530 |
| 5,184,681 | A | 2/1993 | Fontenot | |
| 8,322,432 | B2 * | 12/2012 | Bailey | E21B 33/085 166/344 |
| 8,770,297 | B2 * | 7/2014 | Bailey | E21B 33/085 166/344 |
| 9,010,725 | B2 * | 4/2015 | Hunter | F16K 39/04 251/214 |
| 2004/0040707 | A1 * | 3/2004 | Dusterhoft | E21B 17/206 166/279 |

FOREIGN PATENT DOCUMENTS

| | | |
|---|---|---|
| CA | 2606139 C | 7/2010 |
| EP | 0531038 A2 | 3/1993 |

* cited by examiner

*Primary Examiner* — Gilbert Y Lee
(74) *Attorney, Agent, or Firm* — Helene Raybaud

(57) ABSTRACT

A system includes an annular packer assembly configured to be positioned within an outer annular barrel. The annular packer assembly includes a packer having a radially-inner surface configured to contact an inner annular barrel and a radially-outer surface, and the packer extends axially from a first end to a second end. The annular packer assembly also includes a piston assembly configured to move axially relative to the outer annular barrel to deflect the second end of the packer radially-inwardly into an annular space between the inner annular barrel and the outer annular barrel to seal about the inner annular barrel.

17 Claims, 6 Drawing Sheets

ANNULAR PACKER SYSTEM AND METHOD

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are often employed to access and extract the resource. A subsea drilling and production system may include a riser that extends between a platform (e.g., drilling rig or surface vessel) at a sea surface and a wellhead assembly at a sea floor. In some subsea drilling and production systems, a telescopic joint may be provided between the riser and the platform to compensate for movement of the platform at the sea surface relative to the riser.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
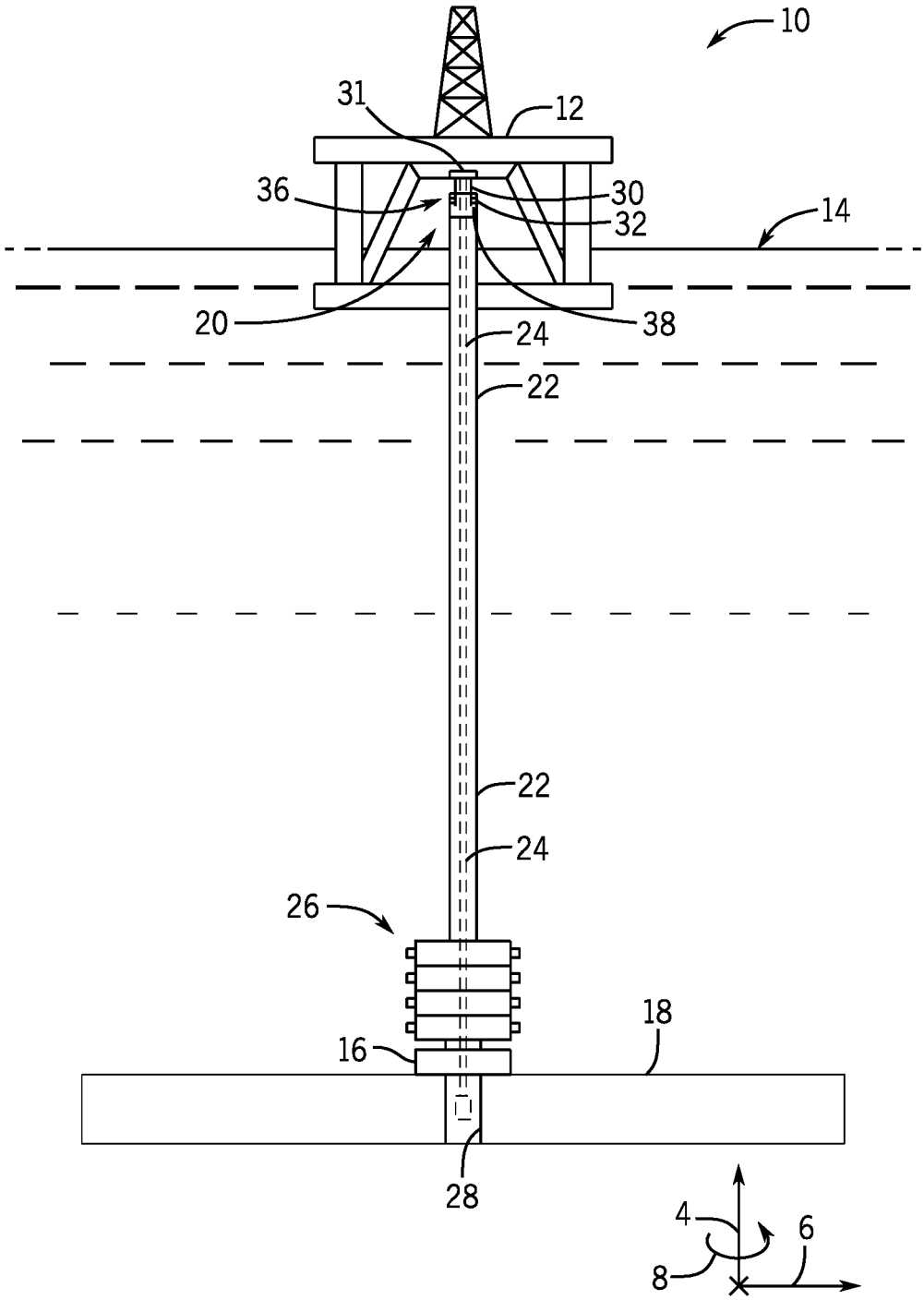
FIG. 1 is a schematic diagram of an offshore system in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is generally directed to a system having an annular packer assembly configured for use within an annulus (e.g., annular space) of a drilling and production system. In offshore drilling and production systems, a riser may extend between a platform (e.g., drilling rig or surface vessel) at a sea surface and a wellhead assembly at a sea floor. A telescopic joint may be provided between the platform and the riser to compensate for movement of the platform relative to the riser, which may be coupled to the wellhead assembly or other components fixed to the sea floor. In certain embodiments, the telescopic joint may include an inner barrel that is coupled to the platform (e.g., via an autolock body or other connector) and an outer barrel that is coupled to the riser. A portion of the inner barrel may be positioned within the outer barrel, and the inner barrel may axially move (e.g., slide) relative to the outer barrel as the platform moves at the sea surface (e.g., due to ocean currents). The telescopic joint includes an annular packer assembly to seal and/or to block fluid flow through an annulus (e.g., annular space) between the inner barrel and the outer barrel of the telescopic joint. In certain embodiments, the annular packer assembly may include a packer (e.g., annular packer), a packer-contacting ring (e.g., annular packer-contacting ring), and a piston (e.g., annular piston) supported by the outer barrel of the telescopic joint. The system may be configured to provide a fluid (e.g., a hydraulic or pneumatic control fluid) or to drive the piston in an axial direction, which in turn drives the packer-contacting ring in the axial direction and enables the packer-contacting ring to contact the packer and to deflect an end of the packer radially-inward to seal against the inner barrel.

In certain embodiments, the disclosed annular packer assembly may include some or all of the following features. For example, the configuration of the annular packer assembly may result in a small contact area between the packer and the inner barrel, which may reduce wear on the packer. The packer may be supported within the outer barrel without bonding (e.g., chemical bonding) the packer to another component of the telescopic joint. The disclosed configuration may enable the packer to be devoid of rigid components (e.g., metal or rigid plastic components molded into the packer) that facilitate attachment (e.g., via threaded fasteners) of the packer to another component of the telescopic joint. At least certain portions (e.g., the packer) of the annular packer assembly may be assembled and/or disassembled (e.g., for installation, inspection, replacement, repair, maintenance) while objects (e.g., a drill string and/or inner barrel) are positioned within a bore of the telescopic joint (e.g., within the outer barrel), which may result in reduced downtime and/or enable efficient installation, repair, and/or maintenance operations. Fluid (e.g., drilling fluid) may be present within the bore of the telescopic joint during assembly and/or disassembly of certain portions (e.g., the packer) of the annular packer assembly, which may result in reduced downtime and/or enable efficient installation, repair, and/or maintenance operations. The configuration of the annular packer assembly may enable a bore pressure (e.g., pressure within the annular space between the inner barrel and the outer barrel) to support (e.g., drive or maintain) the packer against the inner barrel. The system may include a monitoring system (e.g., having a position sensor and an electronic controller) that monitors a position of the piston, which in turn provides an indication of wear on the annular packer and/or a remaining life of the annular packer.

While certain embodiments disclosed herein relate to offshore (e.g., subsea) mineral extraction systems, it should be understood that the systems and methods may be adapted to monitor components of on-shore (e.g., land-based) mineral extraction systems. Furthermore, while certain embodiments described herein relate to using the annular packer assembly within the annulus between the inner barrel and the outer barrel of the telescopic joint of an offshore mineral extraction system, it should be understood that the annular packer assembly may be adapted for use within any of a variety of annular spaces within mineral extraction systems (e.g., between any stationary or dynamic tubular structures, pipes, or the like).

With the foregoing in mind, FIG. 1 is an embodiment of an offshore mineral extraction system 10. To facilitate discussion, the offshore mineral extraction system 10 and its components may be described with reference to an axial axis or direction 4, a radial axis or direction 6, and a circumferential axis or direction 8. As shown, the offshore mineral extraction system 10 includes an offshore drilling rig or platform 12 at a sea surface 14 and a wellhead 16 positioned at a sea floor 18. A telescopic joint 20 is positioned between the platform 12 and a riser 22 (e.g., tubular drilling riser), which extends from the telescopic joint 20 to a blowout preventer (BOP) assembly 26 positioned above the wellhead 16. Downhole operations may be carried out by a drill string 24 (e.g., tubular string) that extends from the platform 12, through the telescopic joint 20, through the riser 22, through the BOP assembly 26, through the wellhead assembly 16, and into a wellbore 28. The telescopic joint 20 may be configured to compensate for movement of the platform 12 at the sea surface 14 (e.g., due to ocean currents and vessel heave) relative to the riser 22, which may be attached to the BOP assembly 26 or to another component that is in a fixed position at the sea floor 18.

As shown, the telescopic joint 20 includes an inner barrel 30 (e.g., annular inner barrel, sleeve, or tubular) that is coupled to the platform 12 (e.g., via an autolock housing or other connector 31) and an outer barrel 32 (e.g., annular outer barrel, sleeve, or tubular) that is coupled to the riser 22. A portion of the inner barrel 30 is positioned within the outer barrel 32 in a coaxial or concentric arrangement, and the inner barrel 30 may move (e.g., slide) relative to the outer barrel 32 as the platform 12 moves at the sea surface 14 (e.g., due to ocean currents and vessel heave). As discussed in more detail below, the telescopic joint 20 includes an annular packer assembly 36 to seal and/or to block fluid flow through an annulus 38 (e.g., annular space) between the inner barrel 30 and the outer barrel 32 of the telescopic joint 20.

Figure 2:
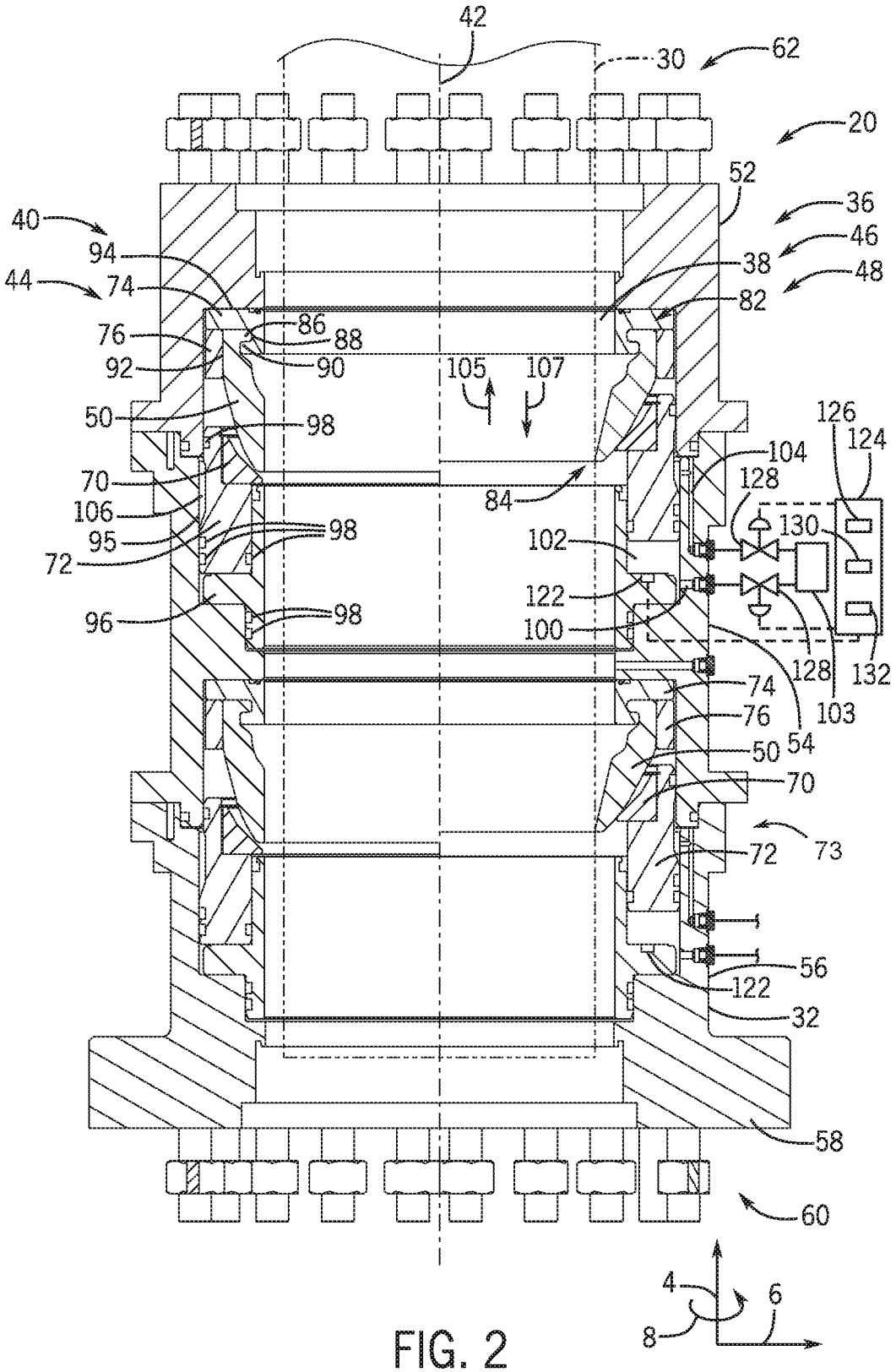
FIG. 2 is a cross-sectional side view of an embodiment of an annular packer system that may be used within the offshore system of FIG. 1, wherein the cross-section is taken within line 2-2 of FIG. 4.
Figure 3:
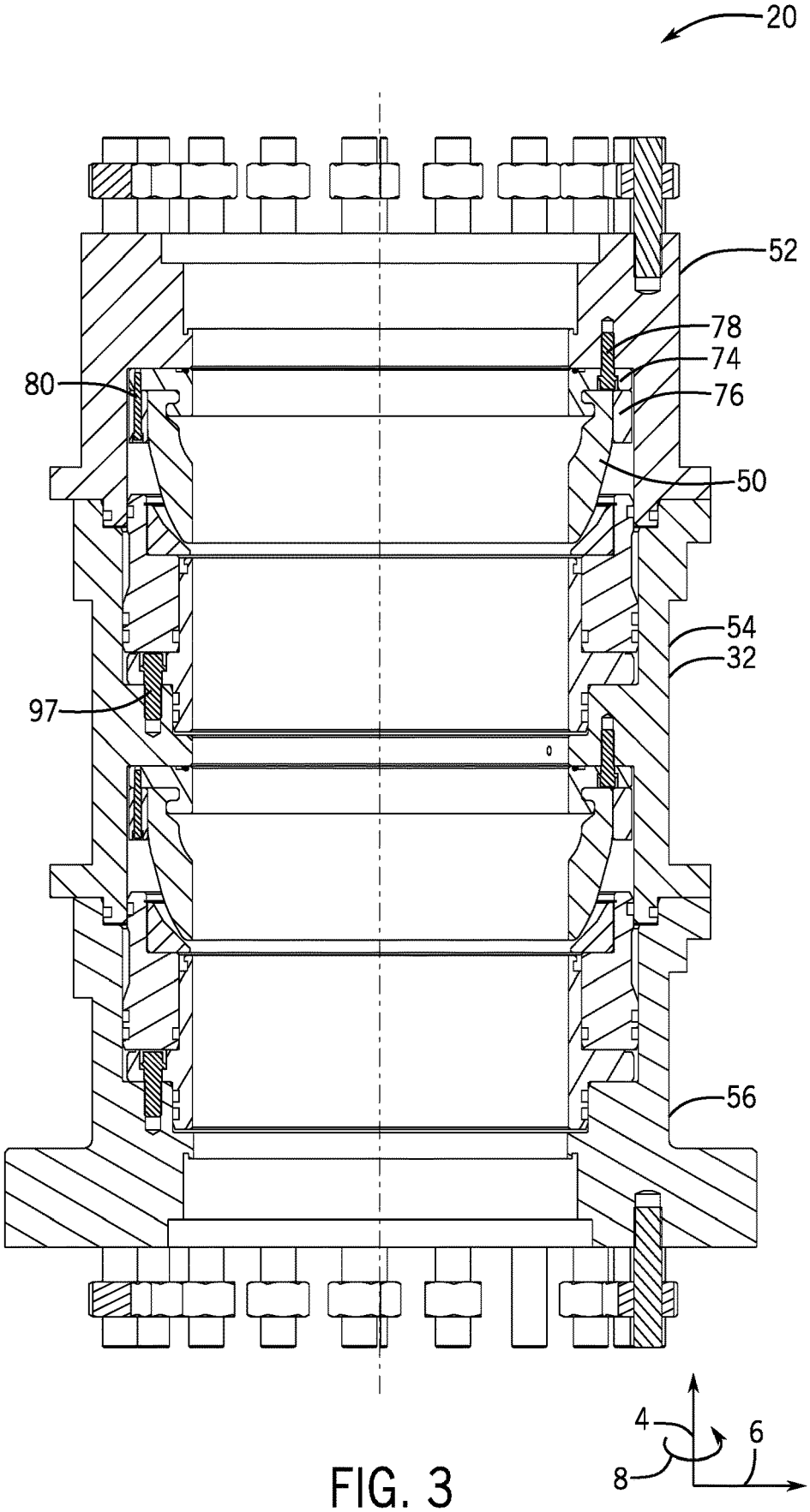
FIG. 3 is another cross-sectional side view of the annular packer system of FIG. 2, wherein the cross-section is taken within line 3-3 of FIG. 4.
Figure 4:
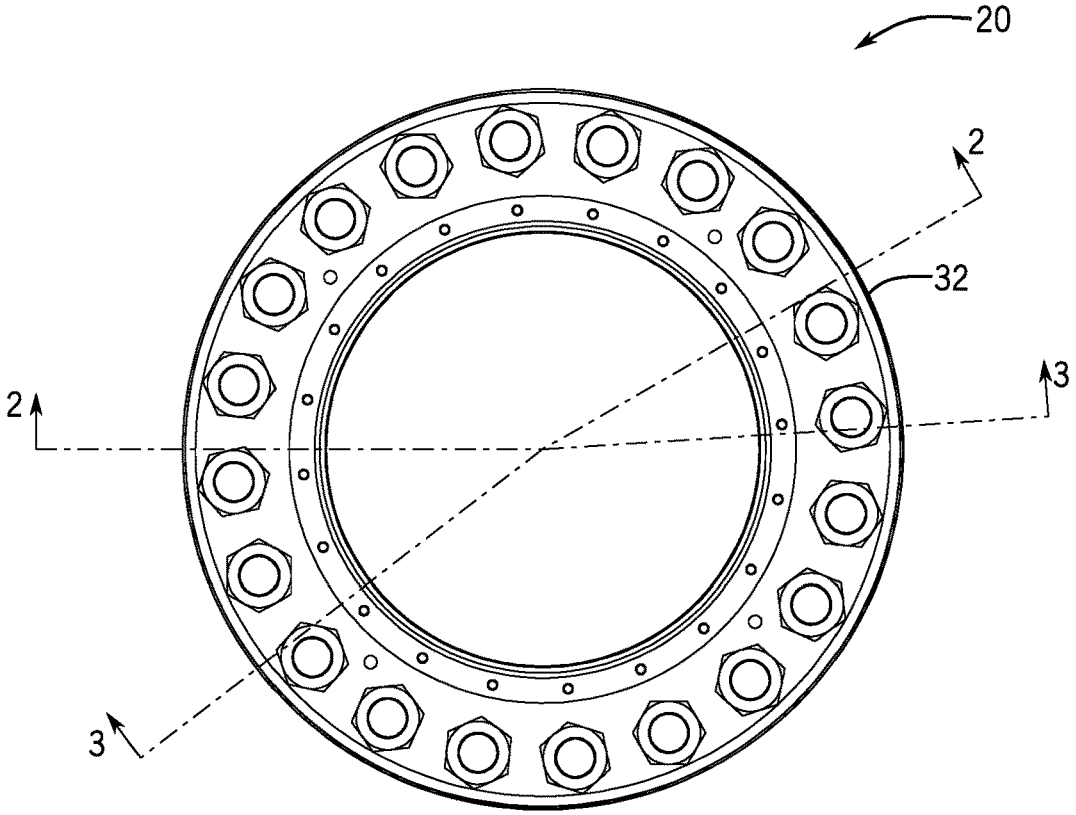
FIG. 4 is a top view of the annular packer system of FIG. 2.

FIGS. 2 and 3 are cross-sectional side views of an embodiment of the telescopic joint 20 having the annular packer assembly 36. The cross-section of FIG. 2 is taken within line 2-2 of FIG. 4, which shows a top view of the telescopic joint 20, and the cross-section of FIG. 3 is taken within line 3-3 of FIG. 4. In FIG. 2, a first side 40 of a central axis 42 illustrates the annular packer assembly 36 in a first position 44 (e.g., an initial position or a resting position), and a second side 46 of the central axis 42 illustrates the annular packer assembly 36 in a second position 48 (e.g., a deflected position or a sealing position). In the first position 44, a packer 50 (e.g., an annular packer or an annular seal) of the annular packer assembly 36 may not contact and/or seal against the inner barrel 30. In the second position 48, the packer 50 of the annular packer assembly 36 may contact and/or seal against the inner barrel 30, thereby blocking fluid flow through the annulus 38.

In the illustrated embodiment, the outer barrel 32 of the telescopic joint 20 includes a first housing 52 (e.g., upper housing or annular housing), a second housing 54 (e.g., intermediate housing or annular housing), and a third housing 56 (e.g., lower housing or annular housing). While these housings 52, 54, 56 are shown as physically separate components, it should be understood that the outer barrel 32 may be formed from any suitable number (e.g., 1, 2, 3, 4, or more) of components or may be a one-piece structure. Furthermore, it should be understood that certain components, such as the packer 50, the outer barrel 32, the housings 52, 54, 56 that form the outer barrel 32, and/or other components disclosed herein, may be annular (e.g., a continuous loop structure) or non-annular (e.g., a multi-piece, segmented, C shaped, or U shaped assembly) that form a generally annular structure when installed within the annular packer assembly 36. Such a configuration may facilitate assembly, installation, inspection, repair, and/or maintenance operations, for example.

In the illustrated embodiment, the outer barrel 32 may be coupled to the riser 22, such as via a flange 58 (e.g., annular flange) at one end 60 (e.g., distal end) of the outer barrel 32. As shown, the inner barrel 30 is positioned within the outer barrel 32 and extends from another end 62 (e.g., proximal end) of the outer barrel 32. The inner barrel 30 may extend toward the platform 12 at the sea surface 14 (e.g., as shown in FIG. 1) and/or may be coupled directly to the platform 12 and/or to a component (e.g., an autolock housing, flex joint, diverter, or other connector) that is in a fixed position relative to the platform 12. Once assembled, the inner barrel 30 may move (e.g., axially slide) relative to the outer barrel 32 (e.g., due to ocean currents and vessel heave) along the axial axis 4.

As shown, the packer 50 is supported by (e.g., suspended by) a support member 74 (e.g., annular support member) and a lock member 76 (e.g., annular lock member). As shown in FIG. 3, the support member 74 may be coupled to the outer barrel 32, such as via one or more fasteners 78 (e.g., threaded fasteners), and the lock member 76 may be coupled to the support member 74, such as via one or more fasteners 80 (e.g., threaded fasteners). It should be understood that in some embodiments, the support member 74 and/or the lock member 76 may be integral with the outer barrel 32 (e.g., the outer barrel 32 may be machined to have the illustrated geometry of the support member 74). In the illustrated embodiment, the packer 50 extends from a first end 82 (e.g., proximal end) to a second end 84 (e.g., distal end). The first end 82 of the packer 50 may be supported by the support member 74 via an interference fit (e.g., key-slot interface, press fit, or the like). As shown, the packer 50 includes a protrusion 86 (e.g., radially-extending annular protrusion or grasp portion) at the first end 82 that is configured to fit within and/or engage a corresponding recess 88 (e.g., annular recess) of the support member 74. Thus, the protrusion 86 may overlap with a portion 90 (e.g., annular portion or grasp portion) of the support member 74 along the radial axis 6, and the packer 50 may be suspended from or hang from the portion 90 of the support member 74 (e.g., be suspended via mating protrusions or grasps 86, 90). To support the packer 50 within the telescopic joint 20 and/or to maintain the protrusion 86 of the packer 50 within the corresponding recess 88 of the support member 74, the lock member 76 may be positioned against a radially-outer surface 92 of the packer 50 and/or circumferentially surround the packer 50.

Such a configuration may enable the packer 50 to be supported within the outer barrel 32 without bonding (e.g., chemical bonding) the packer 50 to another component of the telescopic joint 20. Additionally or alternatively, in some embodiments, this configuration may enable the packer 50 to be formed entirely of a flexible material (e.g., one or more polymers, such as rubber). Additionally or alternatively, in some embodiments, this configuration may enable the packer 50 to be devoid of openings (e.g., holes) for receiving fasteners (e.g., rigid fasteners) and/or to be devoid of rigid components (e.g., metal or plastic components molded into the packer 50) as such rigid components may not be needed to attach (e.g., via threaded fasteners) the packer 50 to another component (e.g., formed from a rigid material, such as a metal or metal alloy) of the telescopic joint 20. In turn, such a configuration may reduce time and/or costs associated with manufacturing and/or installing the packer 50. In some embodiments, the disclosed configuration of the annular packer assembly 36, including the geometry and position of the packer 50, may enable a bore pressure (e.g., pressure within the annular space 38) to support (e.g., drive or maintain) the packer 50 against the inner barrel 30. Thus, during high bore pressure conditions, the packer 50 may be driven by the bore pressure to seal more tightly to the inner barrel 30 (e.g., a contact force between the packer 50 and the inner barrel 30 may vary with the bore pressure).

In the illustrated embodiment, the annular packer assembly 36 includes the packer 50, a packer-contacting ring 70 (e.g., annular element or member), and a piston 72 (e.g., annular piston). In some embodiments, the packer-contacting ring 70 is coupled (e.g., via adhesives, bonds, or fasteners) to the piston 72. In some embodiments, the packer-contacting ring 70 is held in place adjacent to the piston 72 due to the corresponding geometries of the packer 50, the packer-contacting ring 70, and/or the piston 72. Together, the packer-contacting ring 70 and the piston 72 may form a piston assembly 73 that move together relative to the outer barrel 32. The annular packer assembly 36 may be supported within a recess 95 (e.g., annular recess) formed in the outer barrel 32 (e.g., in the second housing 54 and/or the third housing 56 of the outer barrel 32). In some embodiments, a piston-support member 96 (e.g., annular piston-support member) may be provided between the piston 72 and the outer barrel 32 along the axial axis 4. As shown in FIG. 3, the piston-support member 96 may be coupled to and fixed in position relative to the outer barrel 32 via one or more fasteners 97 (e.g., threaded fasteners). In the illustrated embodiment, multiple seals 98 (e.g., annular seals) may be provided between opposed surfaces of the piston 72, the piston-support member 96, and the outer barrel 32.

The components of the telescopic joint 20 may be formed from any of a variety of materials. For example, in some embodiments, the packer 50 may be formed from a flexible material (e.g., one or more polymers, such as rubber), which may have a hardness (e.g., shore hardness or ASTM D2240 durometer) of equal to or less than approximately 50, 60, 70, 80, 90, 100 A, and/or between approximately 30 to 100, 40 to 90, or 50 to 80 A, and/or which may have a tensile strength of equal to or greater than approximately 10, 11, 12, 13, 14, 15, 16, 17, 18, 19, or 20 Megapascal (MPa) (e.g., ASTM D412 tensile strength), and/or between approximately 10 to 20, 12 to 18, 14 to 16 MPa, for example. In some embodiments, the packer-contacting ring 70, the piston 72, the piston-support member 96, the support member 74, and the lock member 76 may be formed from one or more of a polymer, plastic, ceramic, composite, metal, or metal alloy material. In some embodiments, the packer-contacting ring 70 may be formed from a first material (e.g., steel) that is different than and/or more rigid than a second material (e.g., other metal or metal alloy) of the piston 72 and/or different than and/or more rigid than a third material (e.g., rubber) used to form the packer 50.

In the illustrated embodiment, a first fluid passageway 100 extends through the outer barrel 32 to provide a fluid (e.g., pressurized liquid or gas from a fluid source 103) to a first space 102 (e.g., annular space) to drive the piston 72 and the packer-contacting ring 70 along the axial axis 4, as shown by arrow 105. A second fluid passageway 104 extends through the outer barrel 32 to provide the fluid to a second space 106 (e.g., annular space) to drive the piston 72 and the packer-contacting ring 70 along the axial axis 4, as shown by arrow 107. When the pressurized fluid is provided to the first space 102, the packer-contacting ring 70 may contact the packer 50 (e.g., the radially-outer surface 92 of the packer 50) to deflect the second end 84 of the packer 50 radially-inward into the annulus 38 and/or into contact with the inner barrel 30. It should be understood that other actuators (e.g., mechanical or electronic) actuators may be utilized to drive the piston assembly 73 relative to the outer barrel 32. In some embodiments, when packer-contacting ring 70 contacts and drives the second end 84 of the packer 50 radially-inwardly, the second end 84 of the packer 50 may generally rotate (e.g., pivot) about (e.g., relative to) the first end 82 of the packer 50, which is held in place relative to the outer barrel 32 via the mating grasps 86, 90.

In operation, it may be desirable for the packer 50 to maintain contact with the inner barrel 30. In some embodiments, the fluid supplied to the first space 102 is maintained at a predetermined pressure that enables the packer 50 to maintain contact with the inner barrel 30. In the illustrated embodiment, as the packer 50 wears (e.g., as the second end 84 degrades due to the contact with the inner barrel 30 as the inner barrel 30 moves along the axial axis 4 relative to the packer 50), the piston 72 may move axially in the direction of the arrow 105 relative to the outer barrel 32 upon application of the fluid at the predetermined pressure. Thus, a monitoring system 120 may be provided to monitor the position of the piston 72 (and/or other portion of the piston assembly 73) relative to the outer barrel 32, which may be indicative of a condition of the packer 50 (e.g., length, wear, and/or remaining life of the packer 50).

Accordingly, in some embodiments, a monitoring system 120 having one or more sensors 122 (e.g., position sensors) and a controller 124 (e.g., electronic controller) may be provided to monitor the position of the piston 72. The sensor 122 may be any suitable sensor configured to monitor the position of the piston 72, such as any of a variety of proximity sensors, magnetostrictive sensors, hall-effect sensors, optical sensors, acoustic sensors, magnetic sensors, capacitive sensors, or the like. Regardless of the form of the sensor 122, the sensor 122 may be configured to generate a signal indicative of the position of the piston 72. The controller 124 may be configured to receive the signal from the sensor 122 and to process the signal (e.g., using one or more algorithms) to determine the position of the piston 72 relative to the outer barrel 32. In some embodiments, the controller 124 may be configured to determine a displacement of the piston 72, a length of the packer 50 (e.g., along the axial axis 4), a level of wear of the packer 50, and/or estimate a remaining life of the packer 50 based on the position of the piston 72. In some embodiments, the controller 124 may determine a rate of wear of the packer 50 (e.g., wear over time) and/or utilize the determined rate of wear to estimate the remaining life of the packer 50.

In some embodiments, the controller 124 may be configured to provide an output (e.g., via an output device 126) based on the determined position of the piston 72, such as an alarm (e.g., an audible alarm and/or a textual warning message) and/or the determined length of the packer 50, the estimated wear of the packer 50 (e.g., percent worn) and/or the estimated remaining life of the packer 50 (e.g., hour or days remaining and/or number of strokes of the inner barrel 30 across the packer 50 remaining). As shown, in some embodiments, the controller 124 may be configured to provide control signals to control respective valves 128 to control fluid flow to the first passageway 100 and/or the second passageway 104. Thus, in some embodiments, the controller 124 may be configured to automatically adjust the fluid provided to the respective spaces 102, 106 to adjust the position of the piston 72 and/or the packer 50. In some embodiments, the controller 124 may automatically control various components of the telescopic joint 20 and/or various components of the mineral extraction system 10 based on the position of the piston 72, the estimated wear of the packer 50, and/or the estimated remaining life of the packer 50. For example, the controller 124 may control various valves, such as valves to close rams of the BOP assembly 26 and/or the valves 128 to adjust the fluid to cause the annular packer assembly 36 to move to the first position 44, to enable repair and/or maintenance operations (e.g., replacement of the packer 50) when the estimated wear and/or the estimated remaining life of the packer 50 exceeds a predetermined threshold (e.g., equal to or greater than 25, 50, 75 percent worn and/or equal to or less than 72, 48, 24, or 12 hours remaining).

It should be understood that the controller 124 may be a distributed controller or a control system having multiple controllers positioned at various locations about the mineral extraction system 10 and/or at remote locations (e.g., onshore locations). Thus, to the extent that certain processing functions are described as carried out by the controller 124 to facilitate discussion, it should be understood that such processing functions may be carried out by different controllers at various locations. In certain embodiments, the controllers (e.g., the controller 124) disclosed herein are electronic controllers having electrical circuitry configured to process signals. In the illustrated embodiment, the controller 124 includes a processor, such as the illustrated microprocessor 130, and a memory device 132. The processor 130 may be used to execute instructions or software. Moreover, the processor 130 may include multiple microprocessors, one or more "general-purpose" microprocessors, one or more special-purpose microprocessors, and/or one or more application specific integrated circuits (ASICS), or some combination thereof. For example, the processor 130 may include one or more reduced instruction set (RISC) processors.

The memory device 132 may include a volatile memory, such as random access memory (RAM), and/or a nonvolatile memory, such as ROM. The memory device 132 may store a variety of information and may be used for various purposes. For example, the memory device 132 may store processor-executable instructions (e.g., firmware or software) for the processor 130 to execute, such as instructions for processing the signals from the sensor 122, estimating wear of the packer 50, estimating remaining life of the packer 50, and/or providing an output (e.g., an alarm, the estimated wear, the estimated remaining life, or the like). The storage device(s) (e.g., nonvolatile storage) may include read-only memory (ROM), flash memory, a hard drive, or any other suitable optical, magnetic, or solid-state storage medium, or a combination thereof. The storage device(s) may store data (e.g., algorithms, predetermined thresholds, etc.), instructions (e.g., software or firmware for processing the signals, etc.), and any other suitable data. In the illustrated embodiment, the annular packer assembly 36 includes two packers 50 and corresponding components (e.g., packer-contacting ring 70, piston 72, and the like) spaced apart from one another along the axial axis 4. It should be understood that both packers 50 and corresponding components may have the same features and characteristics.

Figure 5:
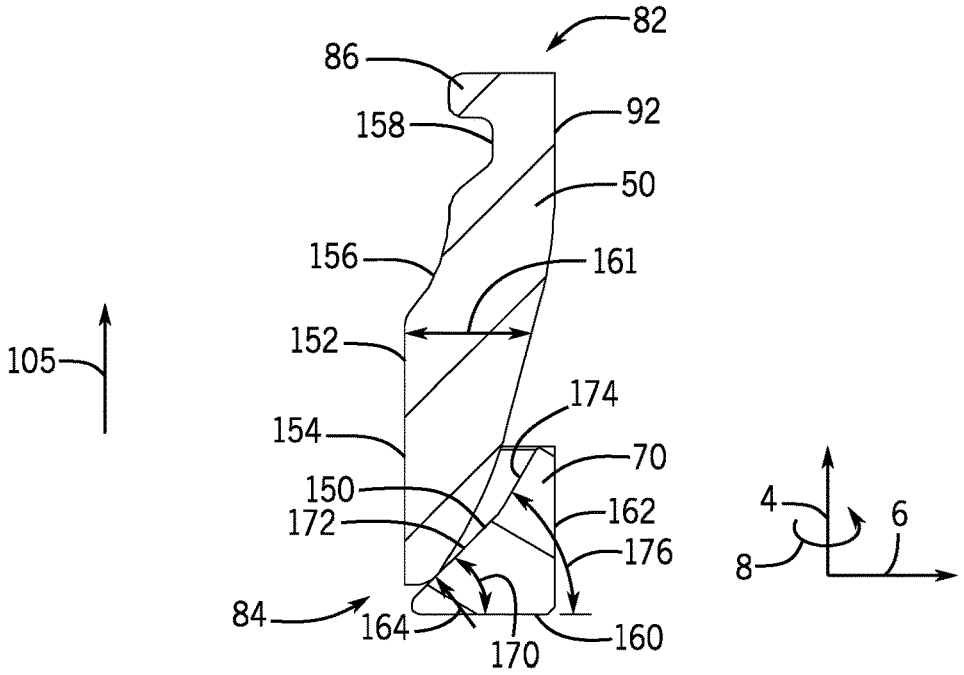
FIG. 5 is a cross-sectional side view of an embodiment of a packer-contacting ring having a dual or multi-gradient angled face that may be utilized within the annular packer system of FIG. 2.

FIG. 5 is a cross-sectional side view of an embodiment of the packer 50 and the packer-contacting ring 70 of the annular packer system 36. The illustrated embodiment is merely intended to be exemplary, and it should be understood that these components may have any of a variety of configurations. As shown, the packer 50 extends from the first end 82 to the second end 84. The first end 82 includes the protrusion 86 that is configured to fit within the recess 88 of the support member 74. At the second end 84, the radially-outer surface 92 of the packer 50 is configured to contact a first surface 150 (e.g., annular surface, camming surface, energizing surface, or the like) of the packer-contacting ring 70, and a radially-inner surface 152 (e.g., annular surface) of the packer 50 is configured to contact the inner barrel 30. In the illustrated embodiment, the radially-outer surface 92 of the packer 50 curves radially-inwardly along the axial axis 4 from the first end 82 to the second end 84. Thus, the radially-outer surface 92 may be described as a curved annular surface, a non-conical surface, or the like. As shown, the radially-inner surface 152 may include a first portion 154 (e.g., annular surface) that extends generally axially (e.g., when the packer 50 is in the first position 44) and a second portion 156 (e.g., annular surface) that curves toward the radially-outer surface 92 along the axial axis 4 from the second end 84 to the first end 82 of the packer 50. The second portion 156 may provide facilitate deflection of the packer 50 toward the inner barrel 30 and/or provide strain relief. As shown, the radially-inner surface 152 includes a third portion 158 that is configured to receive the portion 90 of the support member 74. As shown, a width 161 (e.g., along the radial axis 6) of the packer 50 may vary between the first end 82 and the second end 84 of the packer 50.

In the illustrated embodiment, the packer-contacting member 70 includes the first surface 150 (e.g., a conical surface or dual or multi-gradient angled surface), a second surface 160 (e.g., axially-facing annular surface), and a third surface 162 (e.g., radially-facing annular surface). The second surface 160 and the third surface 162 may be configured to contact the piston 72. The first surface 150 may be configured to contact the radially-outer surface 92 of the packer 50. In operation, as the packer-contacting ring 70 is driven along the axial axis, as shown by the arrow 105, the packer-contacting ring 70 exerts a force 164 on the packer 50 and deflects the packer 50 radially-inwardly into the annular space 38 between the inner barrel 30 and the outer barrel 32 (e.g., via a camming action).

In the illustrated embodiment, an angle 170 between the first surface 150 and the second surface 160 of the packer-contacting ring 70 and/or the radial axis 6 may be approximately equal to or greater than 15, 20, 25, 30, 35, 40, 45, 50, 60, 65, 70, or 75 degrees. In some embodiments, the angle 170 may be between approximately 15 to 75, 20 to 70, 25 to 65, 30 to 60, 35 to 55, or 40 to 50 degrees. In some embodiments, the first surface 150 may include a first portion 172 (e.g., annular surface or conical surface) and a second portion 174 (e.g., annular surface or conical surface), and the first portion 172 and the second portion 174 may be oriented at different angles relative to the second surface 160 and/or the radial axis 6. For example, in the illustrated embodiment, the first portion 172 is oriented at the angle 170 relative to the second surface 160 and/or the radial axis 6, and the second portion 174 is oriented at another angle 176 relative to the second surface 160 and/or the radial axis 6. In some embodiments, the another angle 176 may be approximately equal to or greater than 15, 20, 25, 30, 35, 40, 45, 50, 60, 65, 70, or 75 degrees, and/or the another angle 176 may be between approximately 15 to 75, 20 to 70, 25 to 65, 30 to 60, 35 to 55, or 40 to 50 degrees. The angles 170, 176 enable the packer-contacting ring 70 to deflect the packer 50 into the annular space 38 to contact the inner barrel 30 as the packer 50 wears during operation (e.g., due to the movement of the inner barrel 30). For example, only the first portion 172 of the packer-contacting ring 70 may contact the packer 50 upon initial installation and use of the packer 50; however, as the packer 50 wears and reduces in size, both the first portion 172 and the second portion 174 may contact the packer 50 to deflect the packer 50 into the annular space 38 to contact the inner barrel 30 (e.g., to provide a greater radially-inward bias to the packer 50).

Figure 6:
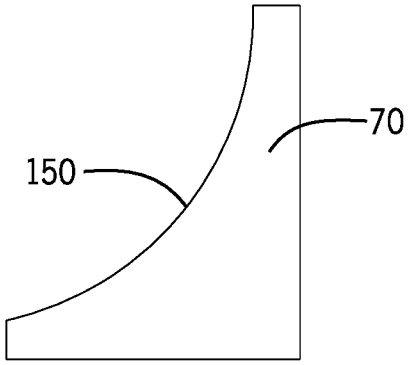
FIG. 6 is a cross-sectional side view of an embodiment of a packer-contacting ring having a curved surface that may be utilized within the annular packer system of FIG. 2.
Figure 7:
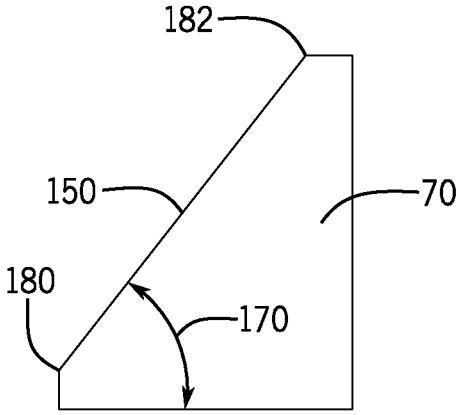
FIG. 7 is a cross-sectional side view of an embodiment of a packer-contacting ring having a single angled face that may be utilized within the annular packer system of FIG. 2.
Figure 8:
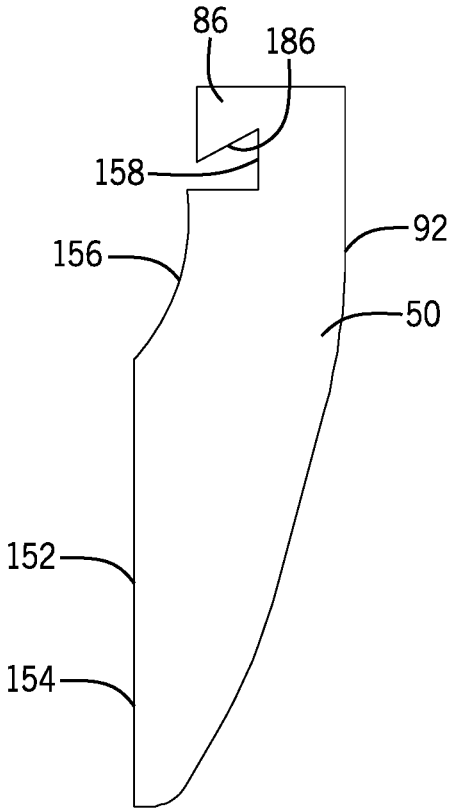
FIG. 8 is a cross-sectional side view of an embodiment of a packer that may be utilized within the annular packer system of FIG. 2.
Figure 9:
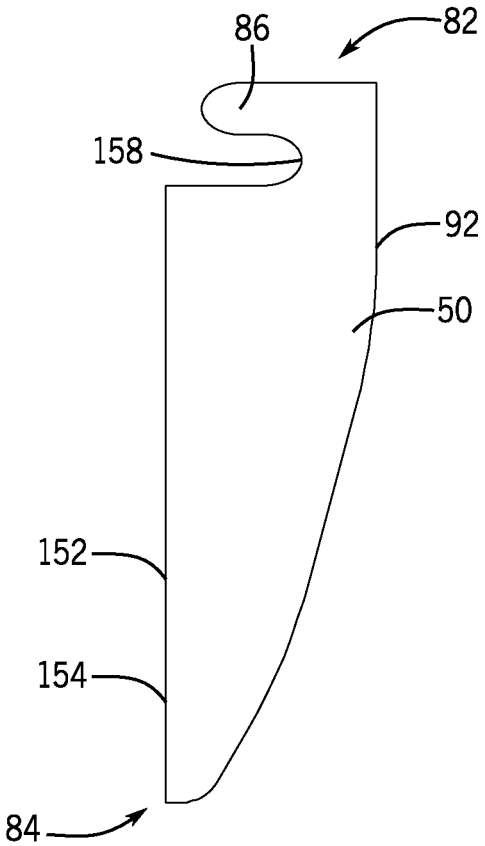
FIG. 9 is a cross-sectional side view of an embodiment of a packer that may be utilized within the annular packer system of FIG. 2.

The packer-contacting ring 70 and the packer 50 may have any of a variety of configurations and the features disclosed herein may be combined in any suitable manner. FIGS. 6-9 illustrated various features that may be incorporated into the annular packer system 36; however, it should be understood that these examples are merely representative and are not intended to be limiting. FIG. 6 is a cross-sectional side view of another embodiment of the packer-contacting ring 70 wherein the first surface 150 (e.g., a non-conical surface, a curved annular surface having a radius of curvature) is curved along the axial axis 4. The radius of curvature may be substantially constant (e.g., within 1, 2, 3, 4, 5, 6, 7, 8, 9, 10) or may vary (e.g., gradually increase or decrease) in the radial direction 6. While the first surface 150 is shown as a concave surface, it should be understood that the surface may be a convex surface, in some embodiments. FIG. 7 is a cross-sectional side view of another embodiment of the packer-contacting ring 70 having the first surface 150 (e.g., a conical surface or single angled surface) extend at the angle 170 from a first end 180 to a second end 152. FIG. 8 is a cross-sectional side view of another embodiment of the packer 50 in which the third portion 158 of the radially-inner surface 152 that is configured to receive the portion 90 of the support member 74 has an angled cross-sectional shape in which an upper-surface 186 is tapered to retain the packer 50 within the outer barrel 32. FIG. 9 is a cross-sectional side view of another embodiment of the packer 50 in which the radially-inner surface 52 extends generally along the axial axis 4 between the portion 158 that receives the portion 90 of the support structure 74 and the second end 84 of the packer 50 while the packer 50 is in the first position 44 (e.g., resting position).

Figure 10:
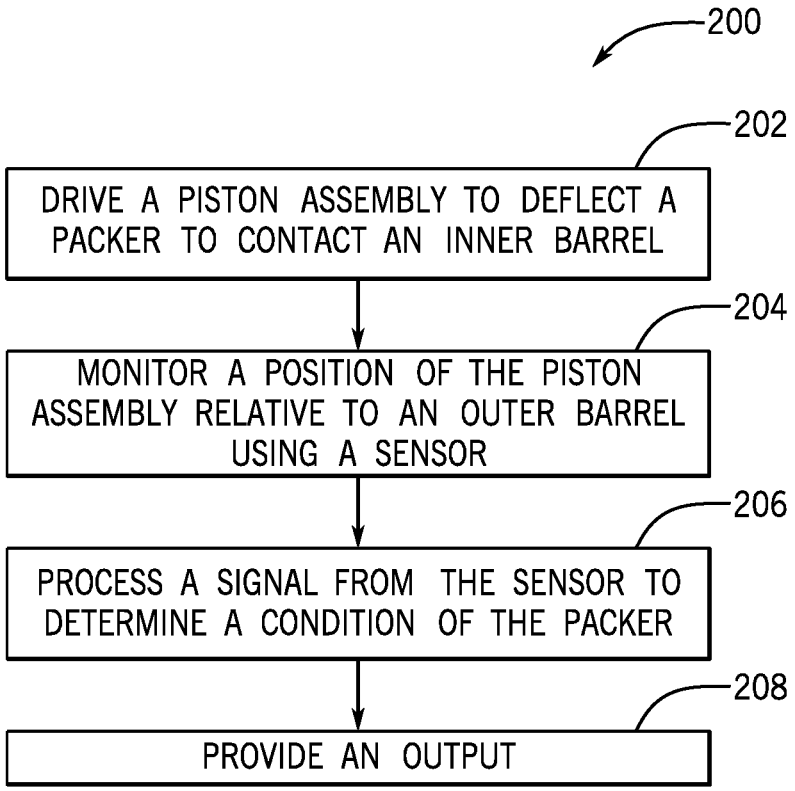
FIG. 10 is a method of monitoring a condition of a packer of the annular packer system of FIG. 2, in accordance with an embodiment of the present disclosure.

FIG. 10 is a flow diagram of an embodiment of a method 200 of operating the annular packer system 36 and monitoring a condition of the packer 50 of the annular packer system 36. The method 200 includes various steps represented by blocks. It should be noted that the method 200 may be performed as an automated procedure by a system, such as the monitoring system 120. Although the flow chart illustrates the steps in a certain sequence, it should be understood that the steps may be performed in any suitable order and certain steps may be carried out simultaneously, where appropriate. Further, certain steps or portions of the method 200 may be omitted and other steps may be added. The steps or portions of the method 200 may be performed by separate devices. For example, a first portion of the method 200 may be performed by the controller 124, while a second portion of the method 200 may be performed by another controller or control system. The method 200 may be carried out periodically (e.g., based on instructions stored in a memory device, such as the memory device 132), in response to operator input (e.g., via an input device), or the like. To facilitate discussion, the method 200 relates to use of the annular packer assembly 36 within the annulus 38 between the inner barrel 30 and the outer barrel 32 of the telescopic joint 20. However, it should be understood that the inner barrel 30 and the outer barrel 32 may be any of a variety of stationary or dynamic tubular structures or pipes within mineral extraction systems, and the method 200 may be adapted for use within any of a variety of annular spaces within mineral extraction systems.

The method 200 may begin by controlling the valve 128 to provide the fluid from the fluid source 103 to the first space 102 to drive the piston assembly 73 (e.g., the piston 72 and the packer-contacting ring 70) along the axial axis 4 toward the packer 50, thereby deflecting the packer 50 radially-inwardly into the annular space 38 to contact the inner barrel 30, in step 202. In step 204, the sensor 122 may monitor the position of the piston assembly 73 relative to the outer barrel 32. As noted above, the sensor 122 may be any suitable sensor configured to monitor the position of one or more components of the piston assembly 73, such as any of a variety of proximity sensors, magnetostrictive sensors, hall-effect sensors, optical sensors, acoustic sensors, magnetic sensors, capacitive sensors, or the like, and the sensor 122 may be configured to generate a signal indicative of the position of the piston 72.

In step 206, the controller 124 may receive the signal from the sensor 122 and may process the signal to determine the length of the packer 50, the wear on the packer 50 (e.g., percent wear) and/or to estimate the remaining life of the packer 50 (e.g., remaining hour or days and/or number of strokes of the inner barrel 30). As noted above, the packer 50 may be held (e.g., supported or driven by the packer-contacting ring 70) in contact with the inner barrel 30 during drilling and/or production operations. As the packer 50 wears (e.g., as the second end 84 degrades due to the contact with the inner barrel 30), the piston assembly 73 may move axially relative to the outer barrel 32 to hold the packer 50 in contact with the inner barrel 30. Thus, the position of the piston assembly 73 relative to the outer barrel 32 may correlate to a condition of the packer 50 (e.g., length, wear, and/or remaining life of the packer 50), and the controller 124 may determine the wear and/or estimate the remaining life of the packer 50. In some embodiments, the controller 124 may determine a rate of wear of the packer 50 (e.g., wear over time) and/or utilize the determined rate of wear to estimate the remaining life of the packer 50.

In step 208, the controller 124 may provide an output (e.g., via the output device 126) based on the determined position of the piston assembly 73, such as an alarm (e.g., an audible alarm and/or a textual warning message) and/or the estimate of the wear of the packer 50 (e.g., percent worn) and/or the estimate of the remaining life of the packer 50 (e.g., days remaining and/or number of strokes of the inner barrel 30 across the packer 50 remaining).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

an annular packer assembly configured to be positioned within an outer annular barrel, comprising:

a packer comprising a radially-inner surface configured to contact an outer surface of an inner annular barrel, wherein the packer extends axially from a first end to a second end;

a hydraulically actuated piston assembly configured to move axially relative to the outer annular barrel to deflect the second end of the packer radially inward toward the inner annular barrel and into an annular space between the inner annular barrel and the outer annular barrel to seal about the inner annular barrel;

a support structure configured to couple to the outer annular barrel, wherein the first end of the packer includes a radially-extending protrusion configured to engage a corresponding recess of the support structure such that the packer hangs from the support structure; and an annular lock ring circumferentially surrounding the first end of the packer to hold the radially-extending protrusion within the corresponding recess.

2. The system of claim 1, wherein the packer curves radially-inwardly along an axial axis from the first end to the second end of the packer.

3. The system of claim 1, wherein the packer is held within the outer annular barrel without being bonded to any component of the outer annular barrel.

4. The system of claim 1, wherein the packer is formed entirely of a flexible polymer material and is devoid of metal or metal alloy inserts.

5. The system of claim 1, comprising a sensor configured to monitor a position of the hydraulically actuated piston assembly relative to the outer annular barrel.

6. The system of claim 5, comprising a controller configured to determine a condition of the packer based on a signal received from the sensor and to instruct an output device to provide an indication of the condition of the packer.

7. The system of claim 6, wherein the condition comprises a wear level of the packer or a remaining life of the packer.

8. The system of claim 1, wherein a bore pressure within the annular space drives the second end of the packer within the annular space to seal about the inner annular barrel.

9. The system of claim 1, comprising the outer annular barrel, a fluid source external to the outer annular barrel, a fluid passageway extending through the outer annular barrel to fluidly couple the fluid source to an annular chamber, and a valve positioned along the fluid passageway to adjust a flow of a fluid from the fluid source to the annular chamber, wherein the fluid from the fluid source in the annular chamber directly contacts and drives the hydraulically actuated piston assembly axially into contact with the packer, and contact between the hydraulically actuated piston assembly and the packer causes the second end of the packer to deflect into the annular space to seal about the inner annular barrel.

10. The system of claim 1, wherein the outer annular barrel and the inner annular barrel are part of a telescopic joint positioned between a riser and a platform of a subsea mineral extraction system that compensates for movement of the platform relative to the riser.

11. A system, comprising:

an annular packer assembly configured to be positioned within an outer annular barrel, comprising:

a packer comprising a radially-inner surface configured to contact an outer surface of an inner annular barrel, wherein the packer extends axially from a first end to a second end;

a hydraulically actuated piston assembly configured to move axially relative to the outer annular barrel to deflect the second end of the packer radially inward toward the inner annular barrel and into an annular space between the inner annular barrel and the outer annular barrel to seal about the inner annular barrel;

wherein contact between a packer-contacting surface of the hydraulically actuated piston assembly is configured to cause the second end of the packer to deflect radially-inwardly into the annular space from an unsealed position in which the second end of the packer does not seal about the inner annular barrel and a sealed position in which the second end of the packer seals about the inner annular barrel, and the packer-contacting surface is oriented at an angle of between approximately 40 to 50 degrees relative to a radial axis of the annular packer assembly.

12. A system, comprising:

a packer configured to be positioned within an outer tubular member and to seal an annular space between the outer tubular member and an inner tubular member, wherein the packer extends axially between a first end having a radially-extending protrusion and a second end configured to contact the inner tubular member to seal the annular space, and the packer is comprised entirely of a flexible material;

an annular support member coupled to or integrally formed with the outer tubular member and comprising a corresponding recess configured to receive the radially-extending protrusion of the packer to support the packer within the outer tubular member without bonding the packer to any components of the system; and a lock member configured to block the radially-extending protrusion from moving radially outward and separating from the corresponding recess in the annular support member, wherein the lock member is between the annular support member and the packer.

13. The system of claim 12, comprising a piston assembly configured to move axially relative to the outer tubular member to cause the second end of the packer to deflect radially-inwardly into contact with the inner tubular member.

14. The system of claim 13, comprising a sensor configured to monitor a position of the piston assembly relative to the outer tubular member and a controller configured to determine a condition of the packer based on a signal received from the sensor.

15. The system of claim 12, wherein the radially-extending protrusion extends radially-inwardly from a radially-inner surface of the packer.

16. The system of claim 12, wherein the annular support member is coupled to the outer tubular member via a fastener or integrally formed with the outer tubular member, and the packer hangs from the annular support member via engagement between the radially-extending protrusion and the corresponding recess.

17. The system of claim 12, comprising:

the outer tubular member;

the inner tubular member;

a riser comprising a first riser end coupled to the outer tubular member and a second riser end coupled to a component of a subsea mineral extraction system that is supported on a sea floor; and a platform coupled to the inner tubular member and positioned at a sea surface;

wherein the outer tubular member and the inner tubular member are part of a telescopic joint that compensates for movement of the platform relative to the riser.

* * * * *